US008968557B2

(12) United States Patent
Baskis

(10) Patent No.: US 8,968,557 B2
(45) Date of Patent: Mar. 3, 2015

(54) METHOD AND APPARATUS FOR CONVERTING COAL TO PETROLEUM PRODUCT

(76) Inventor: Paul T. Baskis, Golconda, IL (US)

( * ) Notice: Subject to any disclaimer, the term of this patent is extended or adjusted under 35 U.S.C. 154(b) by 223 days.

(21) Appl. No.: 13/479,938

(22) Filed: May 24, 2012

(65) Prior Publication Data

US 2012/0298561 A1 Nov. 29, 2012

Related U.S. Application Data

(60) Provisional application No. 61/490,506, filed on May 26, 2011.

(51) Int. Cl.

| | |
|---|---|
| ***C10G 1/00*** | (2006.01) |
| ***C10G 1/04*** | (2006.01) |
| ***C10G 9/14*** | (2006.01) |
| ***C10B 53/04*** | (2006.01) |
| ***C10B 57/08*** | (2006.01) |

(52) U.S. Cl.

CPC ..... *C10B 53/04* (2013.01); *C10G 1/047* (2013.01); *C10B 57/08* (2013.01); *C10G 2400/04* (2013.01)

USPC ..... 208/400; 208/49; 208/50; 208/106; 208/146; 208/424; 196/46

(58) Field of Classification Search

CPC ..... C10B 53/04; C10B 57/08; C10G 1/047; C10G 2400/04

USPC ..... 208/49, 50, 106, 131, 146, 400, 424; 196/46

See application file for complete search history.

(56) References Cited

U.S. PATENT DOCUMENTS

| | | | |
|---|---|---|---|
| 1,434,520 | A | 11/1922 | Ball |
| 2,823,106 | A | 2/1958 | Pierson |
| 2,867,521 | A | 1/1959 | Jeffreys |
| 3,997,437 | A | 12/1976 | Prince et al. |
| 4,076,515 | A | 2/1978 | Rickard |
| 4,289,625 | A | 9/1981 | Tarman et al. |

(Continued)

FOREIGN PATENT DOCUMENTS

| | | | | |
|---|---|---|---|---|
| JP | 61042593 A | * | 3/1986 | ..... C10L 5/00 |
| JP | 7-308688 | | 11/1995 | |

(Continued)

OTHER PUBLICATIONS

Argaw, N.; "Renewable Energy in Water and Wastewater Treatment Applications; Period of Performance Apr. 1, 2001-Sep. 1, 2001"; National Renewable Energy Laboratory; NREL/SR-500-30383; Jun. 2003.

*Primary Examiner* — Walter D Griffin
*Assistant Examiner* — Derek Mueller
(74) *Attorney, Agent, or Firm* — Ungaretti & Harris LLP

(57) ABSTRACT

The present invention provides a method of converting coal to a petroleum product. The method includes the steps of mixing the coal and water to form a mixture, and heating the mixture to approximately 500 degrees Fahrenheit. The method further includes separating the mixture in a first separator into a liquid stream of a water bearing minerals and a solid stream of coal, and transferring the coal from the first separator to a coking reactor wherein the temperature is raised to approximately 1,000 degrees Fahrenheit to drive off lighter fractions of the coal as a gas. The method also includes transferring the gas to a fourth separator to separate water and liquid petroleum product from the gas.

15 Claims, 11 Drawing Sheets

(56) References Cited

U.S. PATENT DOCUMENTS

| | | | | |
|---|---|---|---|---|
| 4,342,650 | A | 8/1982 | Erickson et al. | |
| 4,354,936 | A | 10/1982 | Ishida et al. | |
| 4,655,925 | A | 4/1987 | Tabata et al. | |
| 4,818,405 | A | 4/1989 | Vroom et al. | |
| 4,917,805 | A | 4/1990 | Reid | |
| 5,076,928 | A | 12/1991 | Ballnus | |
| 5,269,947 | A | 12/1993 | Baskis | |
| 5,352,357 | A | 10/1994 | Perry | |
| 5,360,553 | A | 11/1994 | Baskis | |
| 5,543,061 | A | 8/1996 | Baskis | |
| 5,582,732 | A | 12/1996 | Mao et al. | |
| 5,616,241 | A | 4/1997 | Khudenko | |
| 5,647,986 | A | 7/1997 | Nawathe et al. | |
| 5,651,890 | A | 7/1997 | Trost | |
| 5,702,572 | A | 12/1997 | Fujimura et al. | |
| 5,863,433 | A | 1/1999 | Behrends | |
| 5,961,786 | A * | 10/1999 | Freel et al. | 202/121 |
| 5,989,428 | A | 11/1999 | Goronszy | |
| 6,065,224 | A | 5/2000 | Eigner | |
| 6,096,214 | A | 8/2000 | Ripley | |
| 6,254,775 | B1 | 7/2001 | McElvaney | |
| 6,299,774 | B1 | 10/2001 | Ainsworth et al. | |
| 6,315,904 | B1 | 11/2001 | Rose et al. | |
| 6,325,935 | B1 | 12/2001 | Hojsgaard | |
| 6,383,389 | B1 | 5/2002 | Pilgram et al. | |
| 6,569,332 | B2 | 5/2003 | Ainsworth et al. | |
| 6,585,895 | B2 | 7/2003 | Smith et al. | |
| 6,610,205 | B2 | 8/2003 | Sato et al. | |
| 6,830,690 | B2 | 12/2004 | Schmid | |
| 6,942,798 | B2 | 9/2005 | Miller, III | |
| 7,005,068 | B2 | 2/2006 | Hoffland | |
| 7,144,507 | B2 | 12/2006 | Baskis | |
| 7,160,713 | B2 | 1/2007 | Suominen | |
| 7,314,190 | B2 | 1/2008 | Palm | |
| 7,416,668 | B1 | 8/2008 | Theodore | |
| 7,481,940 | B2 | 1/2009 | Clifford, III et al. | |
| 7,485,230 | B2 | 2/2009 | Magner et al. | |
| 7,563,374 | B2 | 7/2009 | McWhirter et al. | |
| 7,604,744 | B2 | 10/2009 | Baskis et al. | |
| 7,638,314 | B2 | 12/2009 | Zappi et al. | |
| 2004/0050777 | A1 | 3/2004 | Khan | |
| 2008/0009055 | A1 | 1/2008 | Lewnard | |
| 2008/0050800 | A1 | 2/2008 | McKeeman et al. | |
| 2008/0050801 | A1 | 2/2008 | Kelly et al. | |
| 2008/0135474 | A1 | 6/2008 | Limcaco | |
| 2008/0135475 | A1 | 6/2008 | Limcaco | |
| 2008/0223783 | A1 | 9/2008 | Sutton | |
| 2008/0311640 | A1 | 12/2008 | Cox et al. | |
| 2009/0227003 | A1 | 9/2009 | Blotsky et al. | |
| 2011/0165638 | A1 | 7/2011 | Kotelko et al. | |

FOREIGN PATENT DOCUMENTS

| | | |
|---|---|---|
| JP | 8-224590 | 9/1996 |
| JP | 2004-167461 | 6/2004 |

* cited by examiner

METHOD AND APPARATUS FOR CONVERTING COAL TO PETROLEUM PRODUCT

CROSS-REFERENCE TO RELATED APPLICATIONS

The present Application claims the benefit of U.S. Provisional Application No. 61/490,506, filed May 26, 2011, the contents of which are incorporated herein by reference.

FEDERALLY SPONSORED RESEARCH OR DEVELOPMENT

N/A

TECHNICAL FIELD

The invention relates to processing of coal. More particularly, the present invention relates to a process of converting coal into a liquid synthetic petroleum.

BACKGROUND OF THE INVENTION

Petroleum products such as oil, gasoline, diesel fuel, and the like, have become very expensive. Their prices will continue to rise as production levels fall.

The present invention will provide an apparatus and method for producing synthetic petroleum products from coal. The high quality synthetic petroleum contains little or no asphaltene component, and high levels of mid-range petroleum products commonly used for fuel or solvents. It will also produce gases containing methylcyclobutane and butane. Finally, the present invention will also produce a solid fuel or coke product that has low ash content, low sulfur, mercury, and chlorine content, with a high energy content. Such fuels are desirable in metallurgical production, and particularly in manufacturing silicon wafers, which requires low levels of contaminants.

The present invention is also environmentally favorable as it is specifically designed to eliminate or minimize use of fossil fuels and carbon dioxide or nitrous oxide emissions. Gas produced during the process can be used to produce energy to run the process or produce more liquid for engineered fuel products.

SUMMARY OF THE INVENTION

The present invention provides a method of converting coal to a petroleum product. The method includes the steps of mixing the coal and water to form a mixture, and heating the mixture to approximately 500 degrees Fahrenheit. The method further includes separating the mixture in a first separator into a liquid stream of a water bearing minerals and a solid stream of coal, and transferring the coal from the first separator to a coking reactor wherein the temperature is raised to approximately 1,000 degrees Fahrenheit to drive off lighter fractions of the coal as a gas. The method also includes transferring the gas to a fourth separator to separate water and liquid petroleum product from the gas.

The present invention also provides an apparatus for converting coal to a petroleum product. The apparatus includes a mixing tank for mixing water and coal to form a mixture, and a stir tank for receiving and stirring the mixture. The apparatus also includes a heater for receiving and heating the mixture to a temperature of approximately 500 degrees Fahrenheit, and a first separator for receiving and separating the mixture into a liquid stream of a water bearing minerals and a solid stream of coal. The apparatus further includes a coking reactor for receiving the stream of coal and wherein the temperature is raised to approximately 1,000 degrees Fahrenheit to drive off lighter fractions of the coal as a gas, and a fourth separator for receiving the gas and separating water and liquid petroleum product from the gas.

BRIEF DESCRIPTION OF THE DRAWINGS

To understand the present invention, it will now be described by way of example, with reference to the accompanying drawings in which.

DETAILED DESCRIPTION

Figure 1:
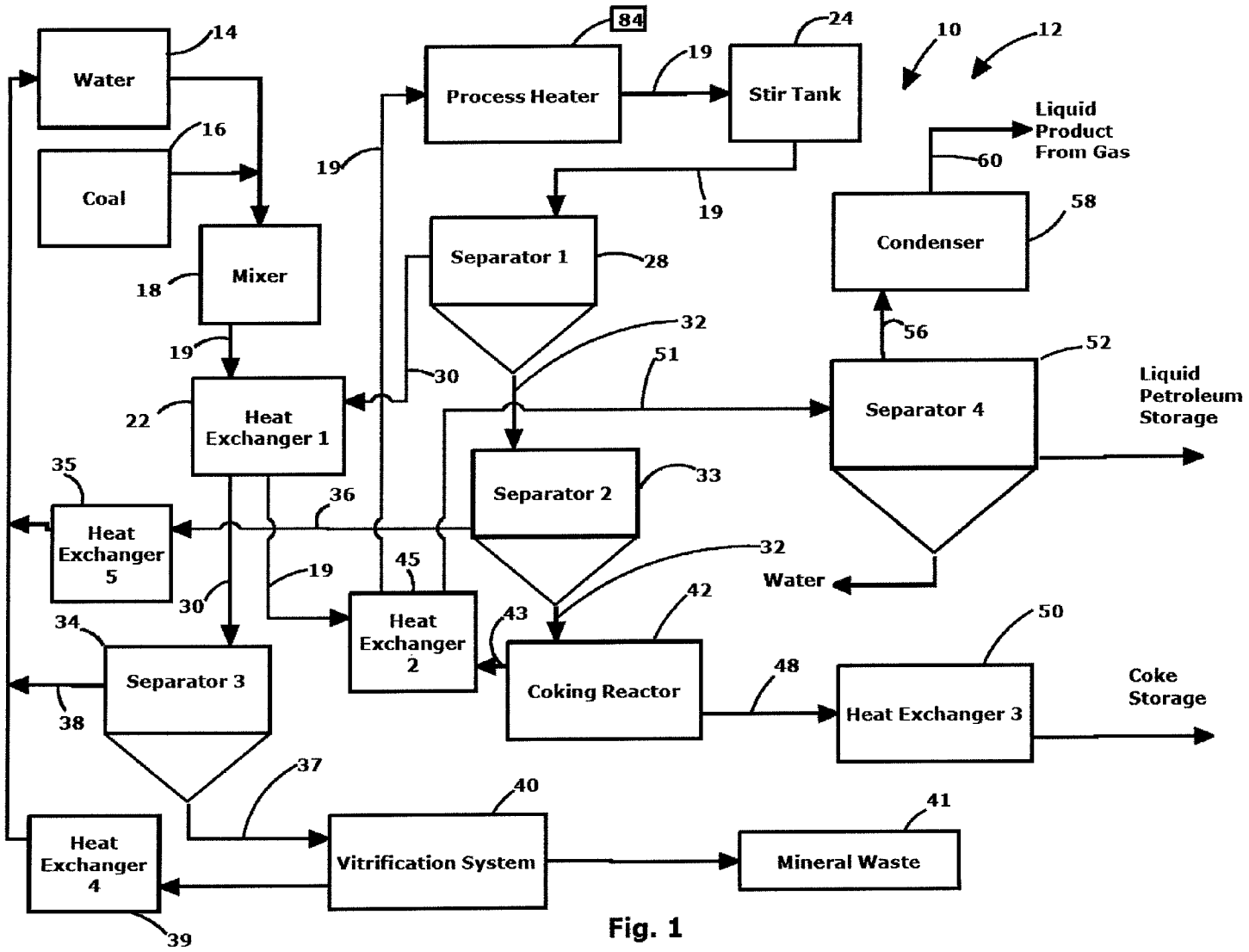
FIG. 1 is a schematic drawing of a process and apparatus in accord with an embodiment of the present invention.
Figure 2:
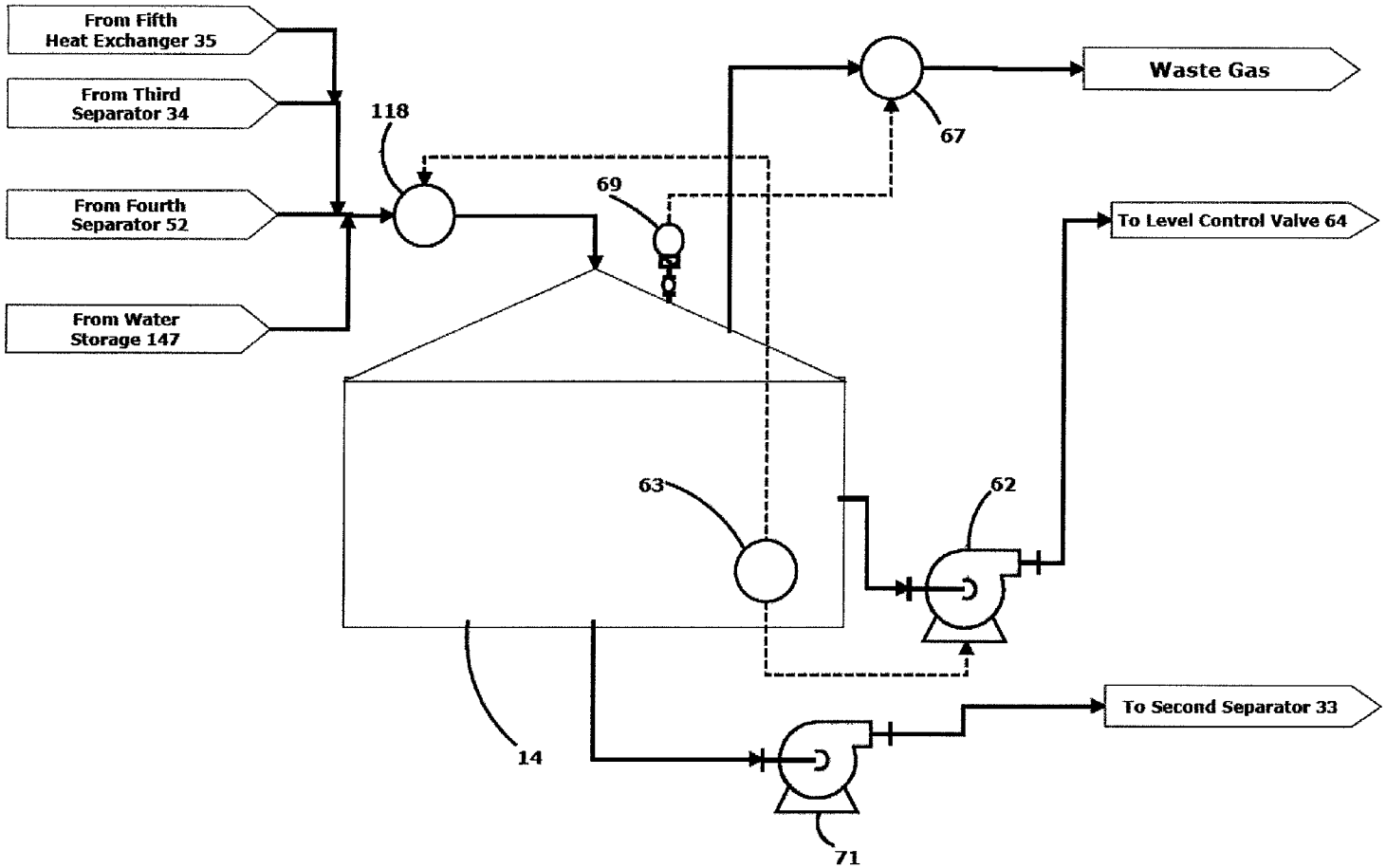
FIG. 2 is a schematic drawing of a water in tank in accord with an embodiment of the present invention.
Figure 3:
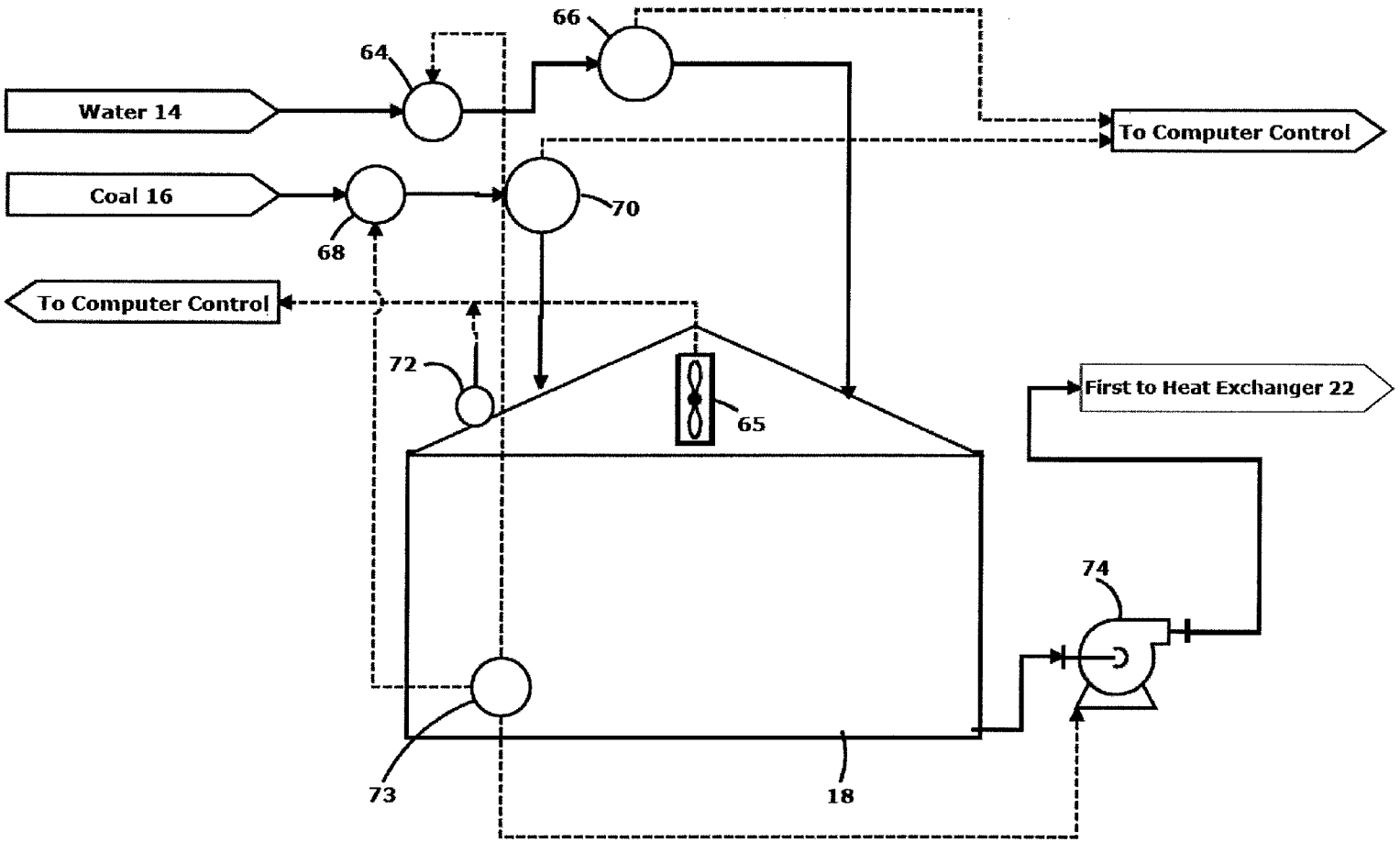
FIG. 3 is a schematic drawing of a mixer and an equalization tank in accord with an embodiment of the present invention.
Figure 4:
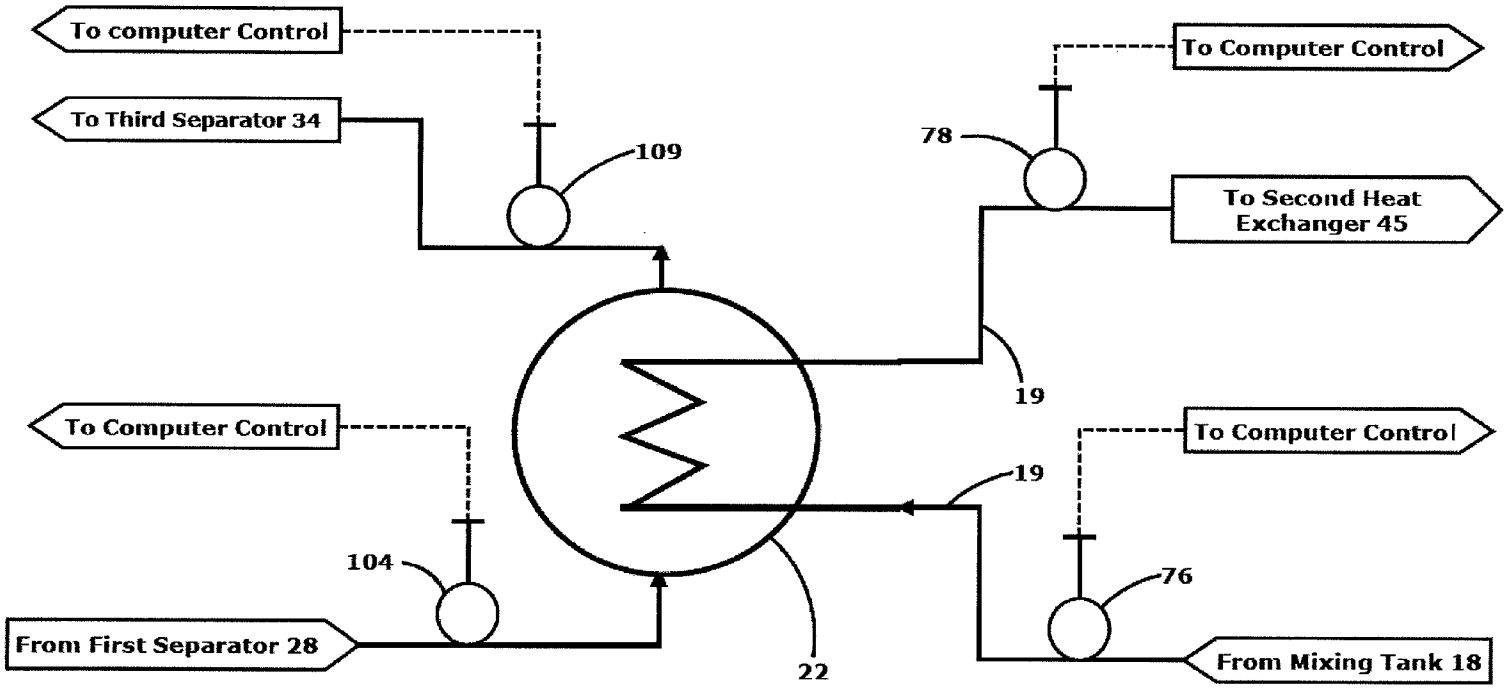
FIG. 4 is a schematic drawing of a heat exchanger in accord with an embodiment of the present invention.
Figure 5:
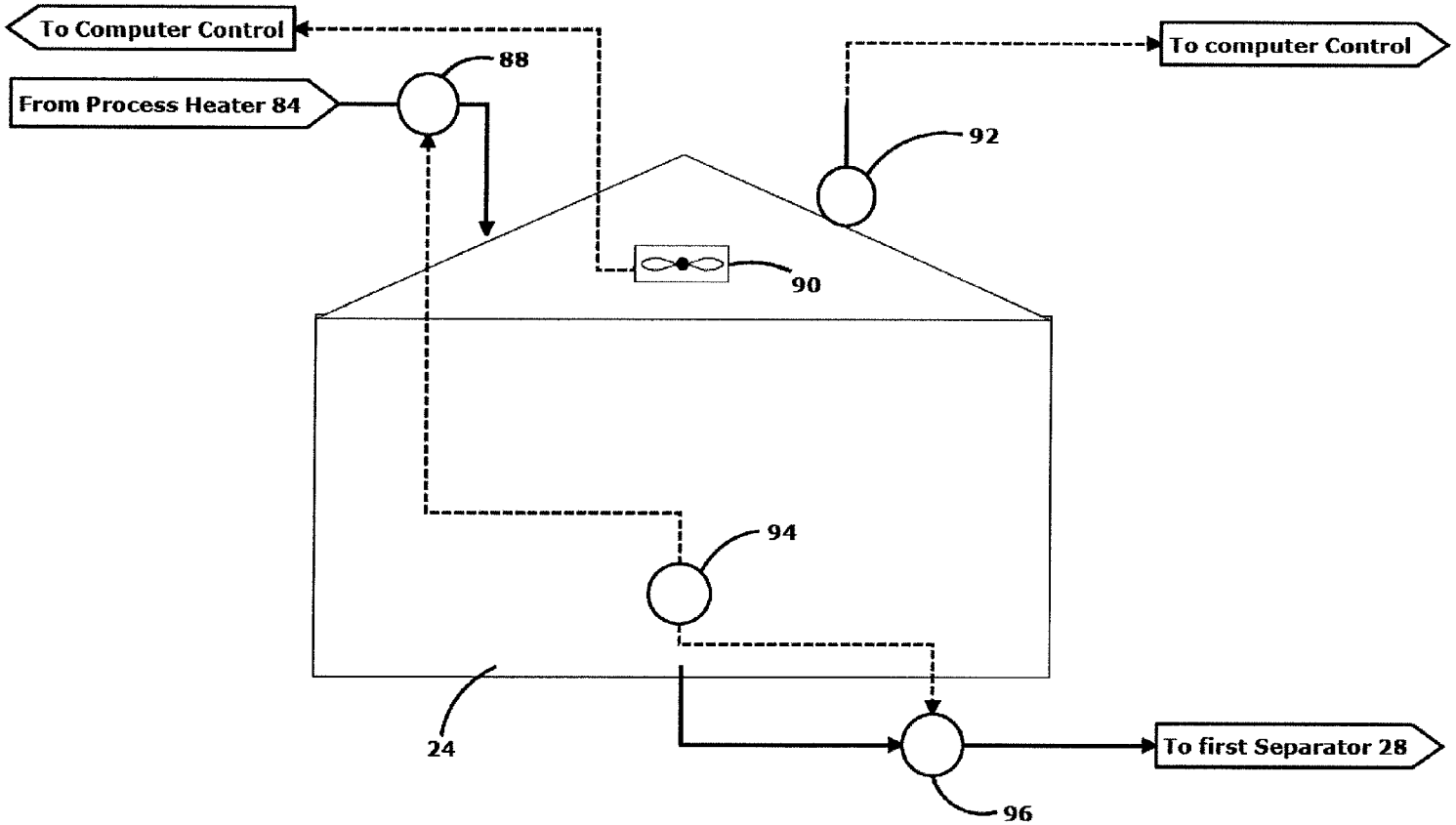
FIG. 5 is a schematic drawing of a stir tank in accord with an embodiment of the present invention.
Figure 6:
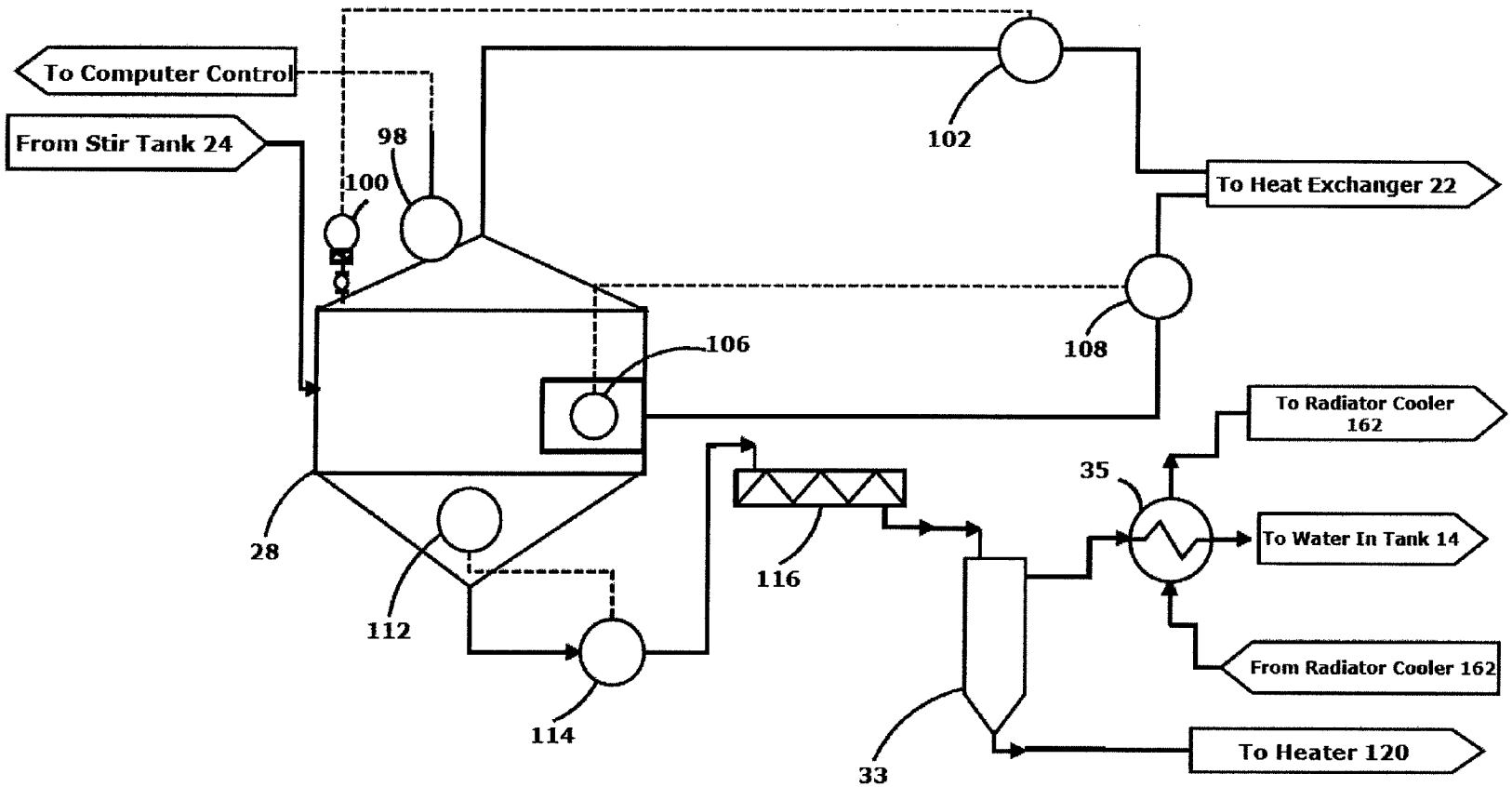
FIG. 6 is a schematic drawing of a first separator in accord with an embodiment of the present invention.
Figure 7:
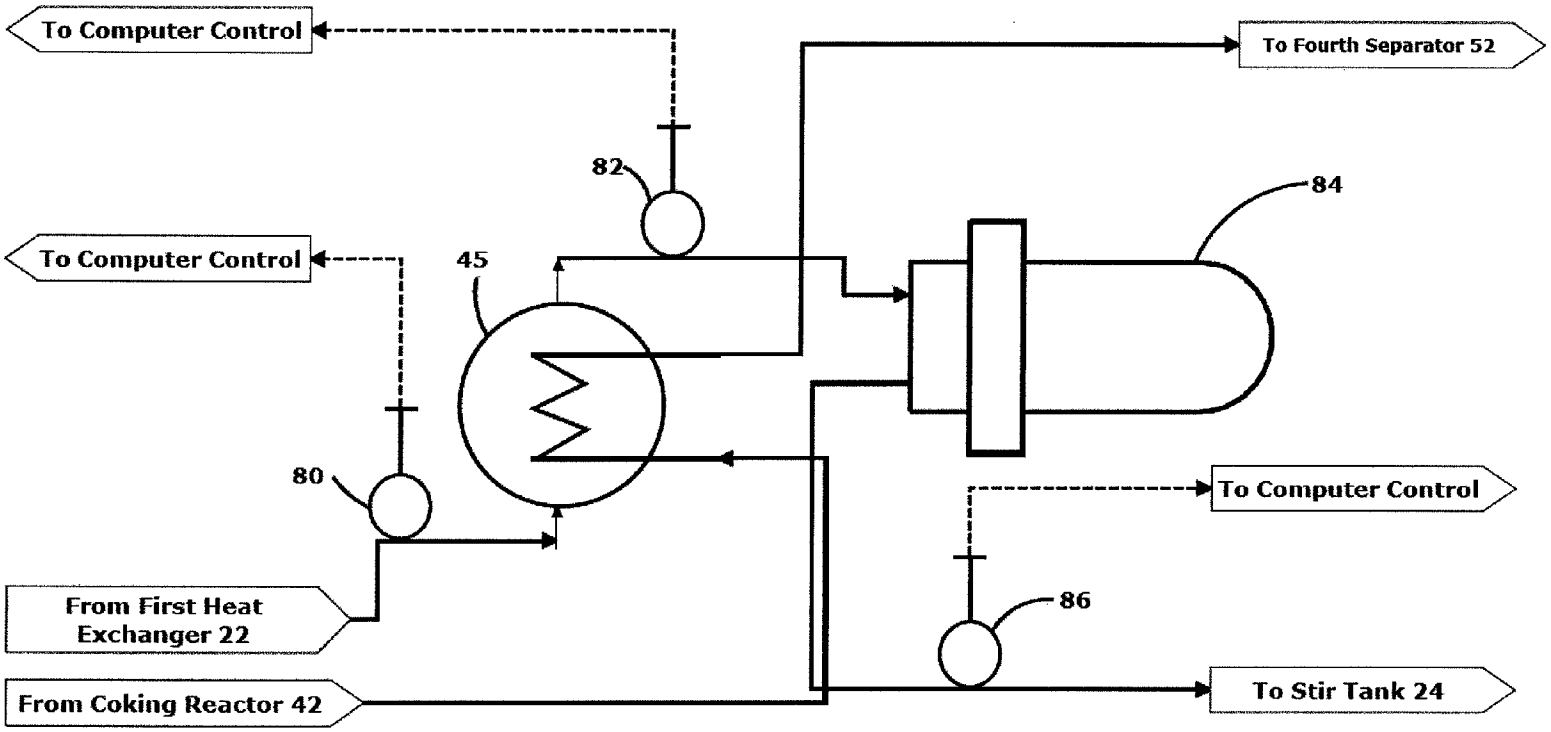
FIG. 7 is a schematic drawing of a heat exchanger and process heater in accord with an embodiment of the present invention.
Figure 8:
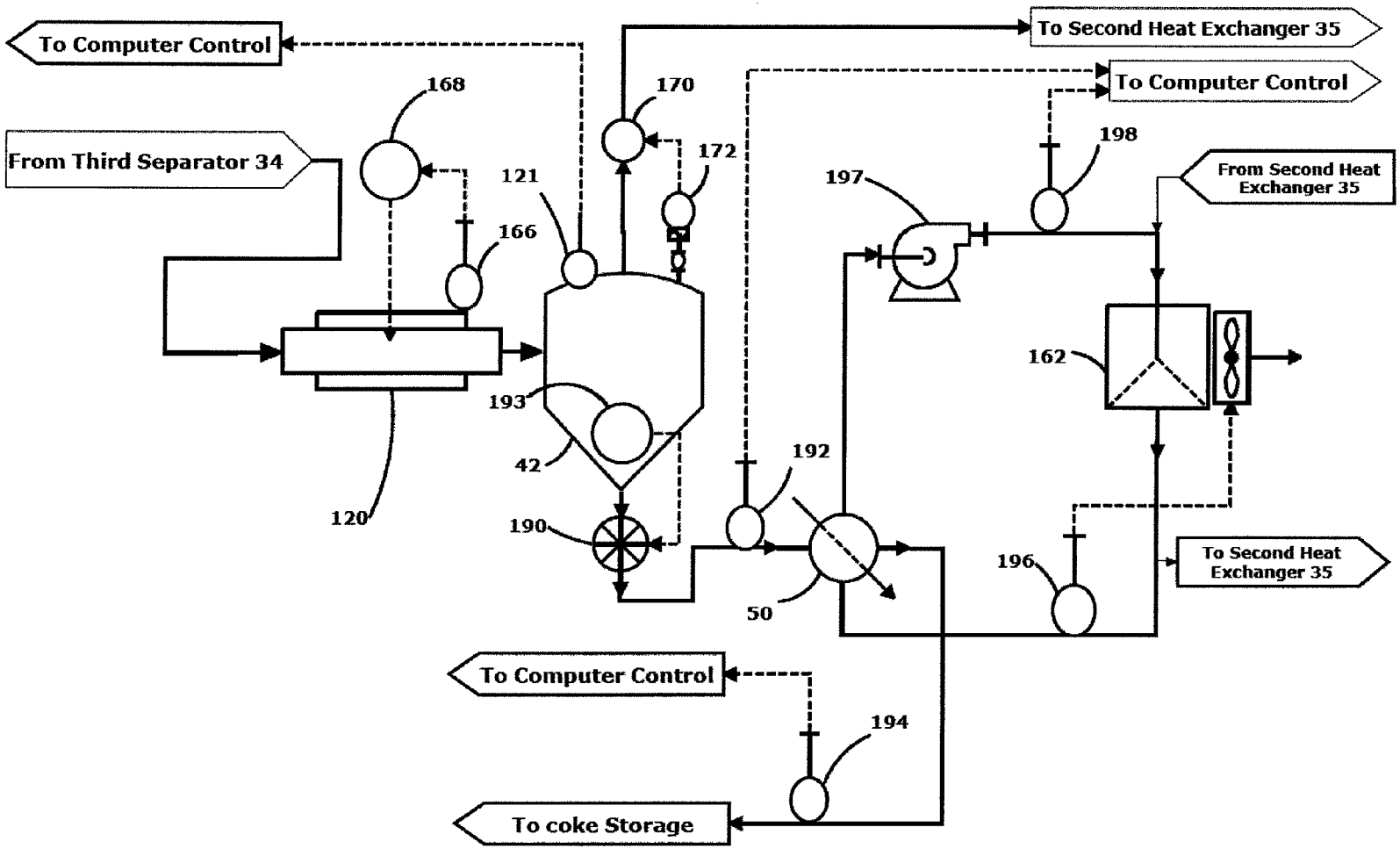
FIG. 8 is a schematic drawing of a coking reactor in accord with an embodiment of the present invention.
Figure 9:
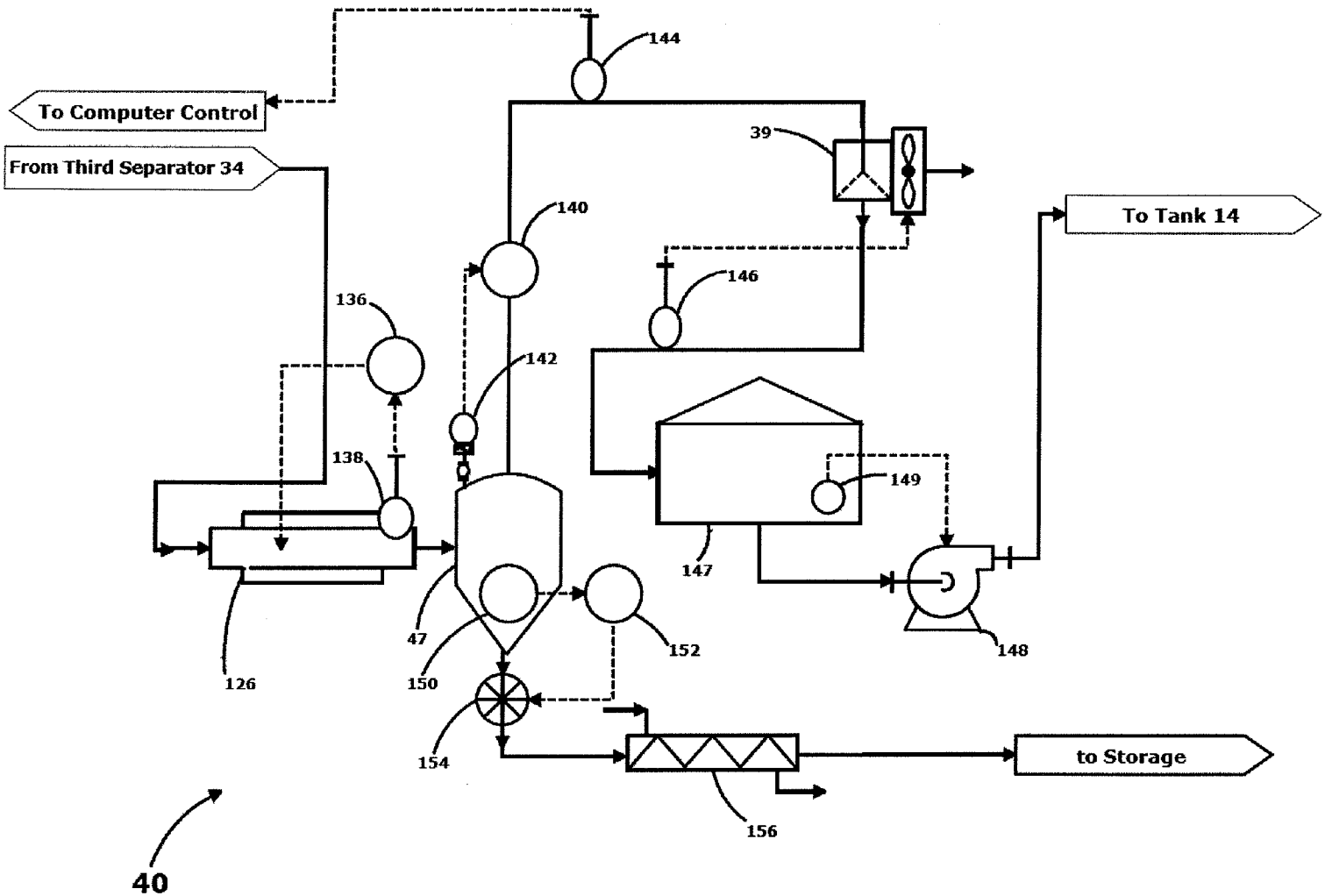
FIG. 9 is a schematic drawing of a mineral vitrification system in accord with an embodiment of the present invention.
Figure 10:
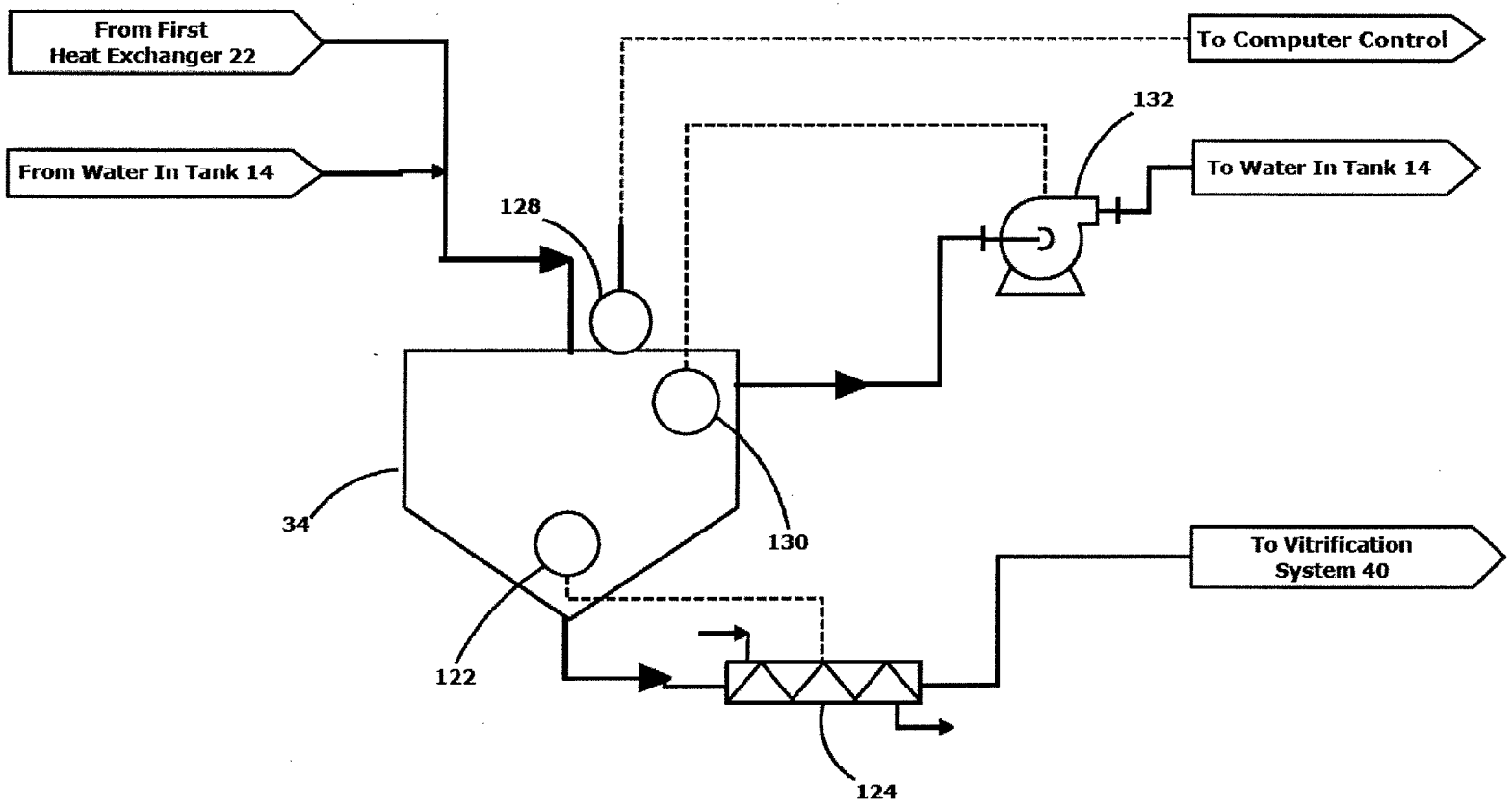
FIG. 10 is a schematic drawing of a third separator in accord with an embodiment of the present invention.
Figure 11:
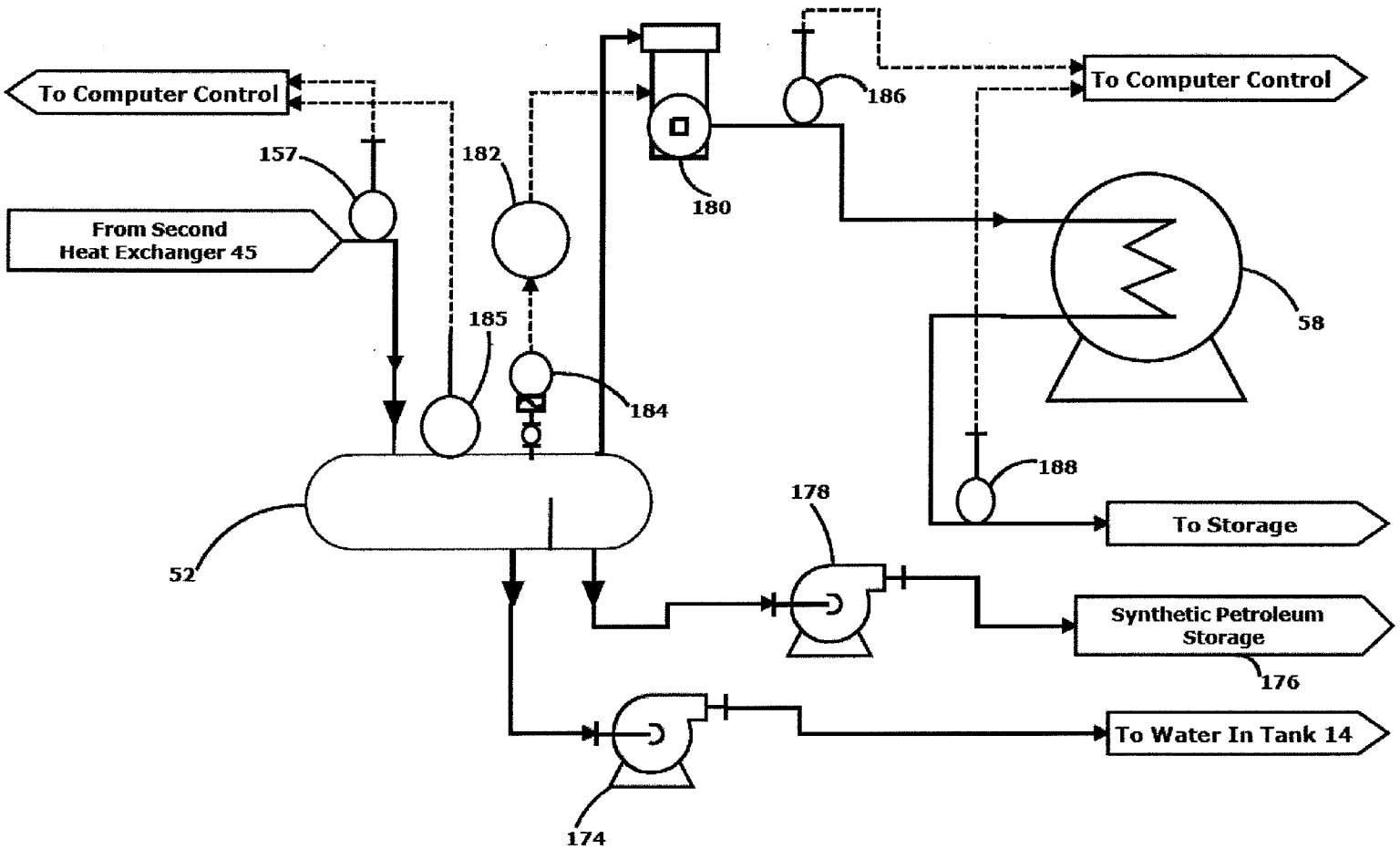
FIG. 11 is a schematic drawing of a condenser and a separator in accord with an embodiment of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1, a process 10 and apparatus 12 is schematically shown for converting coal into a liquid synthetic petroleum product in accord with an embodiment of the present invention. More detailed FIGS. and descriptions of the process and apparatus are included below.

Water in tank 14 and coal 16 are transferred to a mixing tank 18. In the mixing tank 18, the water 14 and coal 16 are mixed to form a mixture 19 thereof. The mixture of water 14 and coal 16 is transferred through a first heat exchanger 22 to a second heat exchanger 45, then through a process heater 84 and into a stir tank 24. The mixture in the stir tank 24 is heated to approximately 250 degrees Celsius or 500 degrees Fahrenheit. The heated mixture remains in the stir tank 24 for approximately one to two hours.

After that time, the heated coal 16 and water 14 mixture 19, with its entrained minerals is transferred to a first separator 28. In the first separator 28, the mixture 19 is separated into a liquid stream 30 of water and minerals, and a solid stream 32 of coal.

The liquid stream 30 of water and minerals is sent through the first heat exchanger 22 and gives up its heat to the incoming mixture 19 of water 14 and coal 16 from the mixing tank 18. The solid coal 32 taken from the bottom of the first separator 28 is transferred to a second separator 33. In second separator 33, water is removed as a vapor 36 and the water vapor 36 and other gases then travel through a fifth heat exchanger 35. The water condensed from the vapor 36 in the fifth heat exchanger 35 is sent to the water 14. The solid coal 32 is removed from the bottom of the second separator 33 and transferred to a coking reactor 42.

In the coking reactor 42, the temperature of the solid coal 32 is raised to approximately 1,000 degrees Fahrenheit to drive off the lighter fractions of the coal 32 as gas 43. Additional water is removed as a vapor with the gas 43 and the water vapor and gas 43 travel to a second heat exchanger 45.

The liquid stream 30, after traveling through the first heat exchanger 22 is transferred to a third separator 34. Here, the minerals 37 and water 38 are separated from the liquid stream 30. The minerals 37 are transferred to a mineral vitrification system 40. The water 38 from the liquid stream 30 is returned to the water 14 to be remixed with coal 16. The water 38 may pass through a fourth heat exchanger 39 before being returned to the water 14. The vitrification system 40 also produces mineral waste 41.

From the coking reactor 42, the cooked carbon 48 travels through a third heat exchanger 50 and into coke storage. The cooled gases 51 from the second heat exchanger 45 travel to a fourth separator 52. Water is removed from the bottom of the fourth separator 52 and transferred to the water 14. Liquid petroleum product is removed using a ware and transferred to a synthetic petroleum storage. Gases 56 are removed from the top of the fourth separator 52 and are transferred to a condenser 58. The condensed liquid product 60 from the gases 56 are sent to storage.

The process and apparatus will now be described in greater detail referring to FIGS. 2 through 11. The water from the water in tank 14 is transferred through a first pump 62 to the mixing tank 18 through a first level control valve 64. The level in the water in tank 14 is maintained by a differential pressure sensor 63. Waste gas is removed from the water in tank 14 through the top of the tank, and is controlled by a pressure control valve 67 that receives pressure information from a pressure indicator 69. Mineral sediment accumulating in the water in tank 14 is removed from the bottom thereof and transferred by pump 71 to second separator 33.

The control valve 64, and other instances in the FIGS. indicated by "To Computer/Control" may all be controlled from a centralized or any suitable control system for the process 10 and apparatus 12. The mixing tank 18 includes a mixer 65. From the first level control valve 64, it flows through a first flow totalizer 66. The coal 16 is transferred through a second flow control valve 68 and then through a second flow totalizer 70 into the mixing tank 18. In the mixing tank 18, the coal 16 and water 14 are thoroughly mixed. The temperature of the mixture 19 is measured using first thermocouple 72. The pressure in the mixing tank 18 is maintained by a differential pressure sensor 73.

The mixture 19 is transferred from the mixing tank 18 by a second pump 74 through a second thermocouple 76 which measures its temperature. The mixture 19 travels through a first heat exchanger 22 where it picks up waste heat from a first separator 28. The mixture 19 then travels through a third thermocouple 78 to determine the output temperature of the mixture 19 leaving the first heat exchanger 22.

The pre-heated mixture 19 then travels to a fourth thermocouple 80 where its temperature is determined as it enters second heat exchanger 45. The mixture 19 material travels through a fourth thermocouple 82 and then into a process heater 84. The process heater 84 heats the mixture 19 to the reaction temperature of approximately 250 degrees Celsius or 500 degrees Fahrenheit. The heated mixture 19 travels through a fifth thermocouple 86 as it leaves the process heater 84 to a first level control valve 88 that controls the level for the stir tank 24. In the stir tank 24, the mixture 19 is mixed by a mixer 90 and cooked for about 1-2 hours at around 250 C/500 F while the temperature in the stir tank 24 is measured using a fifth thermocouple 92. The level of the stir tank 24 is maintained by a differential pressure sensor 94.

The mixture 19 is transferred through a level control valve 96 to the first separator 28. The mixture 19 with minerals entrained is separated in the first separator 28 by use of specific gravity and by phase. In the first separator 28, the water and minerals are separated into a gas vapor stream, a liquid stream of water bearing minerals 30, and a solid stream of coal 32. The temperature in the first separator 28 is measured by sixth thermocouple 98 and pressure is maintained by use of a pressure indicator 100 and a pressure control valve 102. The valve 102 allows the hot gas vapor mostly water and methane to leave the first separator 28 and travel through a seventh thermocouple 104 to the first heat exchanger 22 where it gives up its heat to the incoming mixture 19 of coal and water.

The hot liquid stream 30 of water and minerals is separated using a ware with a first level controller 106. The water travels through a second level control valve 108 and through seventh thermocouple 104 into the first heat exchanger 22. The water 30 is then transferred to the third separator 34. The temperature of the water is measured by thermocouple 109. The solid coal 32 from the bottom of first separator 28 is transferred using a differential pressure separator 112 that controls a third level control valve 114 to a transfer auger 116. The solid coal material 32 is then transferred into second separator 33 where more water is removed as a vapor. The water vapor then travels through the fifth heat exchanger 35, and then to level control valve 118.

The solid coal 32 is removed from the bottom of the second separator 33 and transferred into a heater 120 where it is heated in the coking reactor 42. The temperature of the coking reactor is measured by thermocouple 121. The mineral water 30 from first separator and then through the first heat exchanger 22 and to the third separator 34 now cooled by the first heat exchanger 22 enters the third separator 34. The level of the minerals that are separated is controlled using a differential pressure sensor 122 controls a screw auger 124 that transfers the separate minerals to heater 126 that is part of the mineral vitrification system 40. The cooled water from the fifth heat exchanger 35 is transferred to the water in tank 14. The cooling water for the first heat exchanger 22 is provided by a radiator cooler 162. The temperature exiting the radiating cooler is measured by seventeenth thermocouple 196. Pump 197 transfers the water from the third heat exchanger 50 through thermocouple 198 where the temperature is measured before entering the radiator cooler 162. A stream of this cooled water is transferred to the fifth heat exchanger 35 to provide cooling for the water vapor leaving second separator 33. The coal solids 32 are now transferred to heater 120 where the coal is heated to approximately 1,000 degrees Fahrenheit to drive off the lighter fractions of the coal as gas. The temperature is controlled by twelfth thermocouple 166 that sends information to a temperature control module 168. The heated coal now enters the coking reactor 42 where the gases are removed from the coking reactor 42 a pressure control valve 170 that receives information from a pressure indicator 172.

The temperature of the third separator 34 is measured using an eighth thermocouple 128. The water level in the third separator 34 is controlled by a ware using a level controller 130 and the water travelling through a third pump 132 through level control valve 118 and into the water in tank 14.

The minerals from the third separator 34 are transferred to high temperature heater 126 that is either gas fired or electric heated. This heater 126 heats the minerals 37 to around 1,000 degrees Fahrenheit. The temperature on the heater 126 is controlled by a temperature control module 136 that receives temperature measurements from a ninth thermocouple 138. The heated minerals 37 are transferred into a vitrifier 47, where any gas and water vapor are removed. The removal of the gas or water vapor is controlled by a pressure control valve 140 that receives information from a pressure indicator 142. The gas temperature is measured by a tenth thermocouple 144. The gas then travels through the fourth heat exchanger 39. The temperature of the cooled output water is measured by an eleventh thermocouple 146, and the cooled water is sent to a vitrification water storage tank 147 for storage and then is sent back to the water in tank 14 by a pump 148. The level in the storage tank 147 is maintained by differential pressure sensor 149.

The hot minerals are removed from the vitrifier 47 by weight using a differential pressure sensor 150 and a level controller 152. The hot minerals are transferred through a rotary valve 154 and into a screw conveyor 156 that has a cooling jacket. The cooled minerals are then sent to a mineral storage tank.

The hydrocarbon gas that is being formed off of the coking reactor 42 is transferred to the second heat exchanger 45. The cooled gases travel to the fourth separator 52. The temperature of the cooled gases is measured by thermocouple 157. There the water is removed off of the bottom of the fourth separator 52 and transferred to the water in tank 14 by a pump 174. The liquid petroleum product is removed using a ware and transferred to a synthetic petroleum storage by a pump 178. Gases are removed off of the top of the fourth separator 52 by a pump 180 that is controlled by pressure control module 182. Pressure control module 182 receives information from a pressure indicator 184. The temperature of the fourth separator 52 is measured by thermocouple 185. Gas is transferred through a thirteenth thermocouple 186 where the temperature is recorded as it enters condenser 58. The output temperature of condenser 58 is also by a fourteenth thermocouple 188, and liquid condensed from the gas 60 is sent to storage.

The carbon coke 48 being formed in the coking reactor 42 is transferred through a second rotary valve 190 past a fifteenth thermocouple 192 where the temperature of the incoming coke material is measured as it enters the third heat exchanger 50, which can be an augured cooler. The level in the coking reactor 42 is controlled by the weight of the coal as measured by a level controller 193. The cooled coke is then transferred past a sixteenth thermocouple 194 where the outgoing coke material temperature is measured and then transferred into storage. The gases coming off of coking reactor 42 are transferred to the second heat exchanger 45 where the heat is given off to the incoming coal and water going to the process heater 84.

While the specific embodiments have been illustrated and described, numerous modifications come to mind without significantly departing from the spirit of the invention, and the scope of protection is only limited by the scope of the accompanying Claims.

What is claimed is:

1. A method of converting coal to a petroleum product comprising the steps of:

mixing the coal and water to form a mixture;

heating the mixture to approximately 500 degrees Fahrenheit to dissolve the coal;

separating the mixture in a first separator into a gas vapor stream, a liquid stream of water bearing minerals, and a solid stream of coal;

transferring the coal from the first separator to a coking reactor wherein the temperature is raised to approximately 1,000 degrees Fahrenheit to drive off lighter fractions of the coal as a gas; and transferring the gas to a fourth separator to separate water and liquid petroleum product from the gas.

2. The method of claim 1 wherein the step of heating the mixture is performed in a stir tank, and the mixture is heated for at least one hour.

3. The method of claim 1 further comprising the step of transferring the solid stream of coal to a second separator to separate water vapor from the solid stream of coal.

4. The method of claim 1 further comprising the step of transferring the liquid stream of the water and minerals to a third separator wherein minerals are separated from the water stream and sent to a mineral vitrification system.

5. The method of claim 4 further comprising the step of transferring vitrified minerals through a heat exchanger wherein the vitrified minerals are cooled for storage.

6. The method of claim 1 further comprising the step of transferring carbon product from the coking reactor through a cooler and into storage.

7. The method of claim 1 further comprising the step of transferring gases from the coking reactor to a heat exchanger wherein heat is given off to an incoming coal and water going to a process heater.

8. The method of claim 1 further comprising the step of transferring gas from the fourth separator through a condenser wherein the gas is cooled and additional petroleum liquid results from the condensed gas.

9. A method of converting coal to a petroleum product comprising the steps of:

mixing the coal and water to form a mixture;

heating the mixture to approximately 500 degrees Fahrenheit;

separating the mixture in a first separator into a liquid stream of water bearing minerals, and a solid stream of coal;

transferring the coal from the first separator to a coking reactor wherein the temperature is raised to approximately 1,000 degrees Fahrenheit to drive off lighter fractions of the coal as a gas;

transferring the gas to a fourth separator to separate water and liquid petroleum product from the gas; and transferring the liquid stream of the water and minerals to a third separator wherein minerals are separated from the water stream and sent to a mineral vitrification system.

10. The method of claim 9 further comprising the step of transferring vitrified minerals through a heat exchanger wherein the vitrified minerals are cooled for storage.

11. The method of claim 9 wherein the step of heating the mixture is performed in a stir tank, and the mixture is heated for at least one hour.

12. The method of claim 9 further comprising the step of transferring the solid stream of coal to a second separator to separate water vapor from the solid stream of coal.

13. The method of claim 9 further comprising the step of transferring carbon product from the coking reactor through a cooler and into storage.

14. The method of claim 9 further comprising the step of transferring gases from the coking reactor to a heat exchanger wherein heat is given off to an incoming coal and water going to a process heater.

15. The method of claim 9 further comprising the step of transferring gas from the fourth separator through a condenser wherein the gas is cooled and additional petroleum liquid results from the condensed gas.

* * * * *